United States Patent [19]

Pezzoli

[11] Patent Number: 4,633,915

[45] Date of Patent: Jan. 6, 1987

[54] DEVICE FOR PREVENTING DUST DEPOSITS ON WEFT FEEDERS FOR WEAVING LOOMS

[75] Inventor: Luigi Pezzoli, Leffe, Italy

[73] Assignee: O.M.V. Officine Meccaniche Vilminore S.p.A., Vilminore Di Scalve, Italy

[21] Appl. No.: 746,057

[22] Filed: Jun. 18, 1985

[30] Foreign Application Priority Data

Jun. 27, 1984 [IT] Italy ..... 21628 A/84

[51] Int. Cl.[4] ..... D03D 49/00

[52] U.S. Cl. ..... 139/1 C

[58] Field of Search ..... 139/1 C; 242/27; 28/222, 223; 15/404, 405, 345

[56] References Cited

U.S. PATENT DOCUMENTS

| | | | |
|---|---|---|---|
| 3,743,194 | 7/1973 | Barettella | 242/27 |
| 4,103,714 | 8/1978 | Hasebe | 139/1 C |
| 4,230,158 | 10/1980 | Hintsel | 139/1 C |
| 4,546,799 | 10/1985 | Riesen | 139/1 C |

FOREIGN PATENT DOCUMENTS

| | | | |
|---|---|---|---|
| 485055 | 3/1970 | Switzerland | 139/1 C |

*Primary Examiner*—Henry S. Jaudon

*Attorney, Agent, or Firm*—Young & Thompson

[57] ABSTRACT

A device for preventing dust deposits on weft feeders for weaving looms—of the type wherein the amount of weft yarn being drawn from a reserve wound on a drum of the feeder, to be fed to the loom, is reckoned by a detecting unit—comprises nozzles for blowing blasts of air between the detecting unit and the drum.

2 Claims, 4 Drawing Figures

DEVICE FOR PREVENTING DUST DEPOSITS ON WEFT FEEDERS FOR WEAVING LOOMS

BACKGROUND OF THE INVENTION

It is known that in all the most modern high speed looms, the weft yarn has to be fed to the loom at the lowest and most regular tension, this task being performed by devices, also called weft feeders, which unwind the weft yarn from the feed bobbins and wind a small reserve thereof on a drum, from which said yarn is picked by the weft insertion members of the loom.

It is also known that in some types of more modern looms, as air or water looms, the weft feeding members are provided with means for detecting the yarn amount being drawn, so as to feed the loom with the right weft length to be inserted at each beating up.

Said detecting means usually comprise a group of photoelectric cells, through which it is possible to read and count the number of turns (or turn fractions) outgoing from the winding unit. The proper working of the device essentially depends on the exact reading and counting of the turns by the photoelectric cells. This is not always easy to obtain as, in practice, it happens very often that one has to operate in the presence of dust flakes which, passing through the field of action of the photoelectric cells, cause undesired signals and hence improper working of the device. If a dust flake interferes with the detecting unit and crosses the light beam of a photoelectric cell, this latter can count it as an outgoing turn.

SUMMARY OF THE INVENTION

The present invention proposes to eliminate this drawback, which is quite serious for the efficient and reliable working of weaving looms. For this purpose, it supplies a device for preventing dust deposits on weft feeders, comprising means adapted to blow blasts of air between said detecting unit and said drum.

In practice, said means may consist of a plurality of nozzles, parallel to said unit and surrounding the same at a short distance therefrom, which blow air towards the surface of said drum on which the weft yarn reserve is wound.

Alternatively, the blowing means may consist of a tubular ring surrounding the drum and having holes facing the same, said ring being supplied with air through an appropriate intake and being mounted close to the detecting unit of the feeder.

BRIEF DESCRIPTION OF THE DRAWINGS

The invention will now be described in further detail, with reference to the accompanying drawings, which represent two alternative embodiments thereof and in which.

DESCRIPTION OF THE PREFERRED EMBODIMENTS

Figure 1:
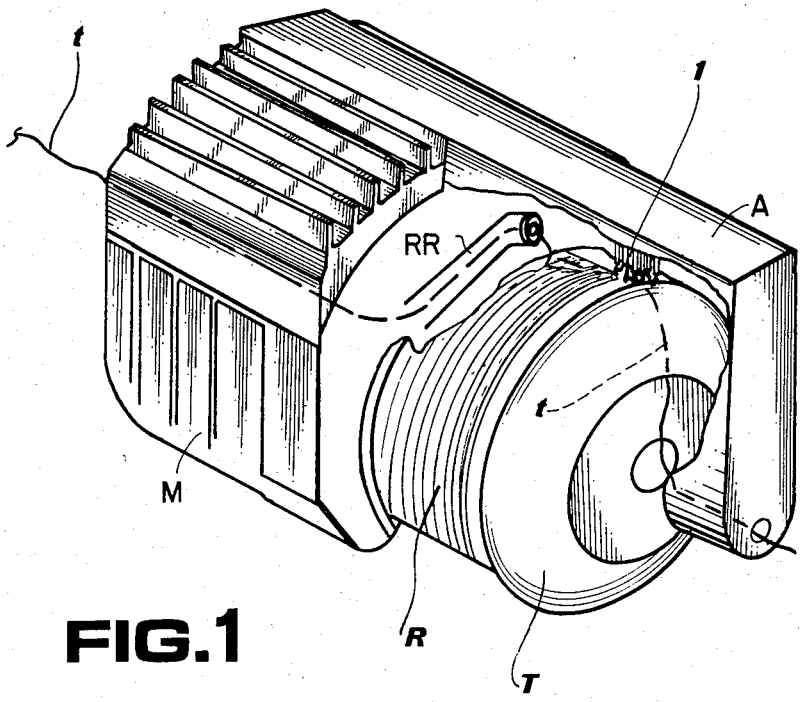
FIG. 1 is a perspective view of a weft feeder equipped with a first embodiment of the device for preventing dust deposits, according to the invention.
Figure 3:
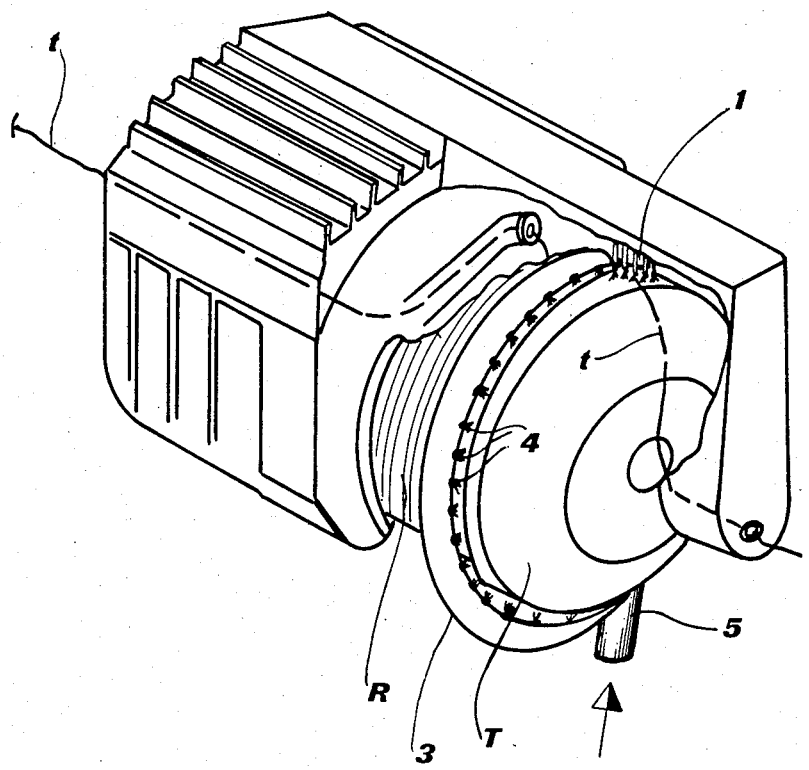
FIG. 3 is a perspective view of a weft feeder equipped with a second embodiment of the device for preventing dust deposits, according to the invention.

With reference to the drawings, FIGS. 1 and 3 show a weft feeding device, of the type wherein a reserve R of weft yarn t is wound on a drum T held stationary. A conventional rotating reel RR, driven by a motor M, distributes the reserve R on drum T.

Reference 1 indicates the group of photoelectric cells forming the unit for detecting the amount of yarn being fed to the loom. These cells are conventionally mounted on the tailpiece A of motor M.

Figure 2:
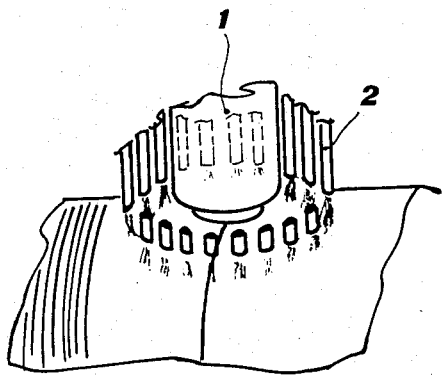
FIG. 2 is an enlarged scale detail of the device shown in FIG. 1.

As better shown in FIG. 2, these photoelectric cells are surrounded—in the embodiment of FIGS. 1 and 2—by a plurality of nozzles 2, parallel to said group 1 and arranged at a short distance therefrom, through which blasts of air are sent to hit the area of the reserve turns R controlled by the photoelectric cells. The air circulation ensuing therefrom removes any dust heaping up between the detecting unit 1 and the drum T, in the area of action of the photoelectric cells, thereby guaranteeing precision and uniformity in the counts detected by said unit.

Figure 4:
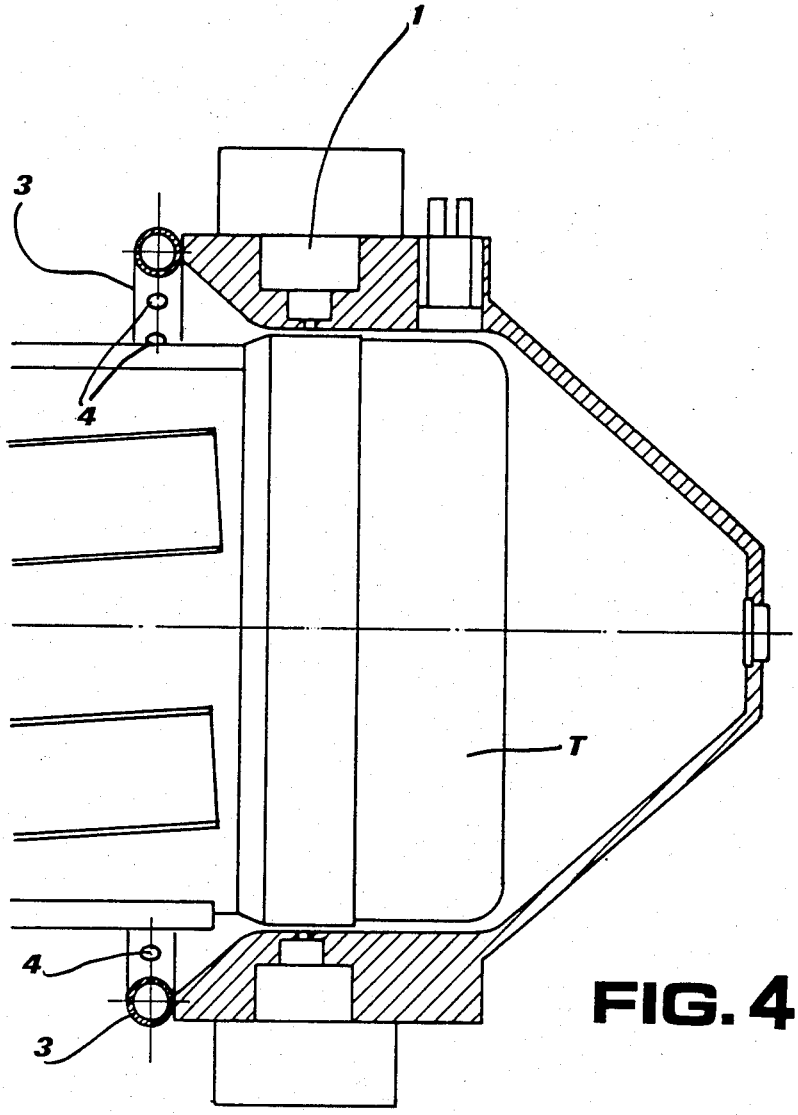
FIG. 4 is an enlarged scale axial section view of the device shown in FIG. 3.

The embodiment shown in FIGS. 3 and 4—wherein the group of photoelectric cells forming the detecting unit of the amount of yarn being fed to the loom is again marked by reference 1—provides, according to the invention, a tubular ring 3 around the drum T, close to the area of the reverse turns R controlled by the photoelectric cells 1. The ring 3 has a plurality of holes 4 facing the drum T and is supplied with air through an intake 5. In this way, a plurality of air blasts—which can be suitably directed, so as to obtain the best results—hit the area of the reserve R being detected by the group of photoelectric cells 1, removing therefrom any trace of dust, to guarantee precision and unformity in the counts detected by said group.

With either embodiment of the invention, some tiny dust particles floating in the air may possibly penetrate the areas of control, but these can be tolerated by the photoelectric cells, as the latter are sensitive only to shades of a certain consistency and a regular dust removal prevents the forming of thick dust deposits.

A double action can thus be obtained, namely to prevent the forming of dust deposits, and to prevent—by appropriately directing the blasts of air—the inlet of large particles in the area controlled by the photoelectric cells.

It is to be understood that there may be various systems of ventilation and that the air supplied to the nozzles 2 or to the holes 4, to be blown onto the drum T, may be sent through different paths. The air current may be generated either through blowers, operated if desired by the same propelling unit of the weft feeder, or through nozzles connected with the compressed air supply system, in the case of air looms.

It is also to be understood that the blasts of air may even be differently arranged, or be otherwise obtained, than in the two aforedescribed embodiments, and that they may be aimed in any suitable direction, chosen in each case by the designer. Nevertheless, the arrangements adopted will always have to effectively prevent dust from depositing between the detecting unit and the yarn reserve being wound on the drum and/or to divert any dust flakes from said area.

In particular, the tubular ring 3 of FIGS. 3 and 4, may be positioned downstream of the detecting unit 1, and not upstream thereof. In this case, the holes 4 will have to be set in a direction substantially opposite to that of yarn unwinding.

It is furthermore to be understood that the invention will also cover an arrangement wherein the detecting unit is positioned on the inner side of the drum T, instead of the outer side. In this case, also the blowing means can be positioned on the inner side of said drum.

I claim:

1. In a weft feeder for a weaving loom, comprising a drum about which a reserve of weft yarn is wound and a detecting unit for detecting the amount of weft yarn in the reserve; the improvement comprising a plurality of nozzles parallel to said unit for blowing blasts of air toward said drum between said detecting unit and said drum to prevent dust from causing a false reading by said detecting unit.

2. In a weft feeder for a weaving loom, comprising a drum about which a reserve of weft yarn is wound and a detecting unit for detecting the amount of weft yarn in the reserve; the improvement comprising a tubular ring surrounding the drum and having holes facing the drum, and means to supply air to the interior of said ring for blowing blasts of air toward said drum between said detecting unit and said drum to prevent dust from causing a false reading by said detecting unit, said ring being disposed closely adjacent said detecting unit.

* * * * *